United States Patent [19]

Goeders

[11] 4,306,718

[45] Dec. 22, 1981

[54] PORTABLE PITCHING MOUND

[75] Inventor: John J. Goeders, Altoona, Iowa

[73] Assignee: True-Pitch, Inc., Altoona, Iowa

[21] Appl. No.: 116,042

[22] Filed: Jan. 28, 1980

[51] Int. Cl.[3] ..... A63B 71/00

[52] U.S. Cl. ..... 273/25

[58] Field of Search ..... 273/25, 183 A

[56] References Cited

U.S. PATENT DOCUMENTS

| | | | |
|---|---|---|---|
| 2,122,266 | 6/1938 | Seys | 273/25 |
| 2,756,999 | 7/1956 | Orsatti | 273/25 |
| 3,479,028 | 11/1969 | Goeders | 273/25 |
| 3,703,285 | 11/1972 | Perry et al. | 273/25 |
| 3,837,646 | 9/1974 | Goeders | 273/25 |
| 3,994,501 | 11/1976 | O'Donnell | 273/25 |
| 4,063,729 | 12/1977 | Hallaway | 273/25 |

*Primary Examiner*—Richard C. Pinkham
*Assistant Examiner*—T. Brown
*Attorney, Agent, or Firm*—Zarley, McKee, Thomte, Voorhees & Sease

[57] ABSTRACT

A portable arcuate shell member supported by its peripheral edge. A pitching rubber is mounted centrally thereof. A depression area extends from the pitching area forwardly from the rubber to the forward end of the shell member. A plate member is detachably secured to the depression area. A layer of resilient cushion material is secured to the plate member, and a layer of turf material is secured to the cushion material. A strip of friction material is secured to the peripheral edge of the shell member.

5 Claims, 6 Drawing Figures

PORTABLE PITCHING MOUND

BACKGROUND OF THE INVENTION

Portable pitching mounds such as those of U.S. Pat. No. 3,479,028 have served well to provide pitching mounds where conventional mounds could not be used (i.e. gymnasiums) or were not available. However, the footing or traction on the surface of the mounds is not the best, particularly as the pitcher completes the pitching motion. Further, the means of securing these mounds to a supporting surface are not always adaptable to both indoor and outdoor use.

SUMMARY OF THE INVENTION

The pitching mound of this invention uses a panel insert located in front of the pitching rubber. The panel is located in a depression within the mound and is comprised of a base plate, a layer of cushion material, and an upper layer of turf material. The panel is detachably secured to the mound. A layer of frictional material is secured to the lower peripheral edge of the mound to secure it to a supporting surface.

The device of this invention thus provides much better footing for the pitcher. The panel can be removed and replaced when required. The mound will not move on a supporting surface when being used, and the mound can be used equally well both indoors and outdoors.

DESCRIPTION OF THE PREFERRED EMBODIMENT

Figure 1:
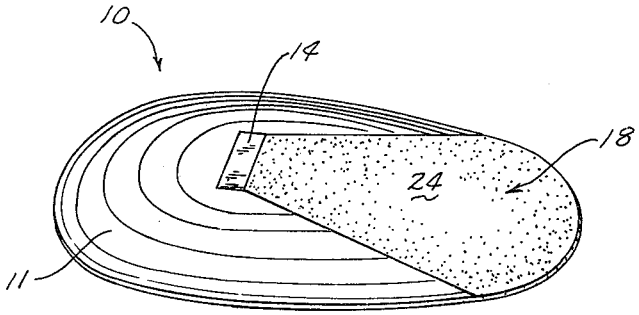
FIG. 1 is a perspective view of the pitching mound of this invention.
Figure 2:
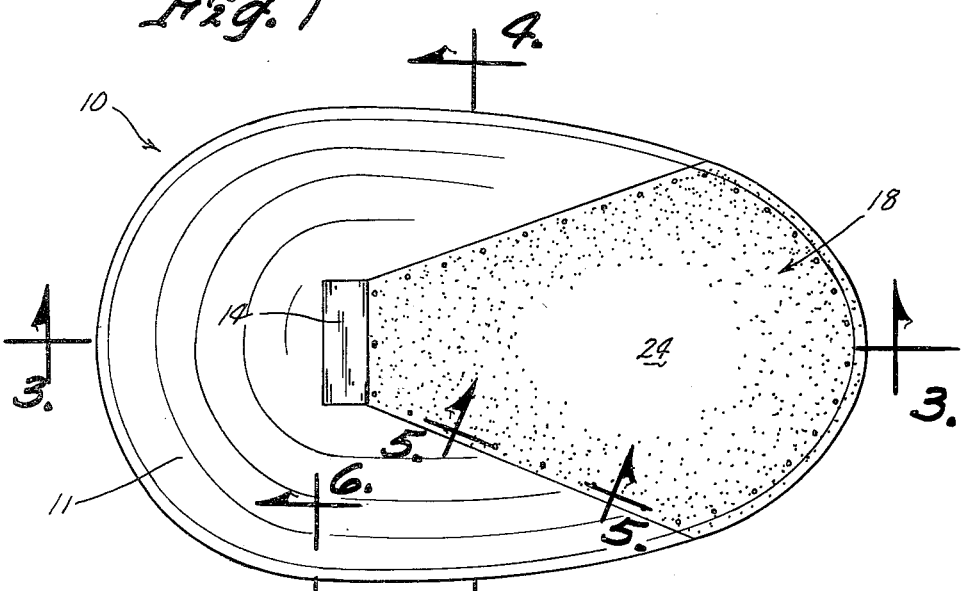
FIG. 2 is a longitudinal sectional view at an elongated scale taken on line 2—2 of FIG. 1.
Figure 3:
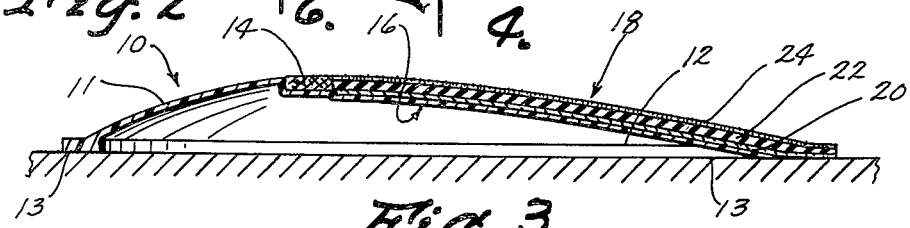
FIG. 3 is a plan view thereof.
Figure 4:
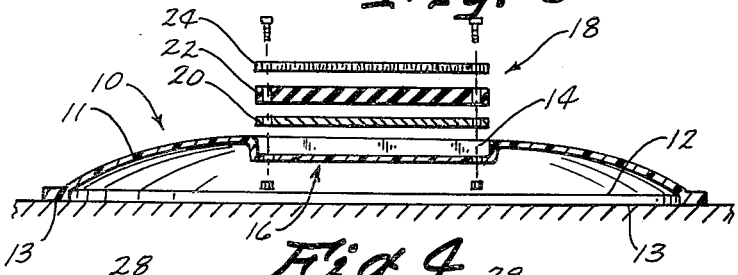
FIG. 4 is a sectional view taken on line 4—4 of FIG. 3.

The numeral 10 designates the mound which is normally formed as a fiberglass shell 11 of oval shape and arcuate in cross-section. The mound 10 is supported on a lower peripheral edge 12 to which is glued a strip of frictional material 13 such as Astro-Turf® or the like.

A pitching rubber 14 is secured to the central portion of the mound, and a depressed area 16 is formed in the shell 11. Area 16 extends forwardly and outwardly from the rubber 14.

Panel 18 has a shape similar to that of depression 16. The panel is comprised of a lower supporting plate 20, a layer of resilient cushion material 22 of foam rubber or the like, and a layer of turf material 24 such as Astro-Turf® or the like. Layers 22 and 24 can be glued together, and layer 22 can be glued to plate 20 which can also be comprised of fiberglass. Nut and bolt elements

Figure 5:
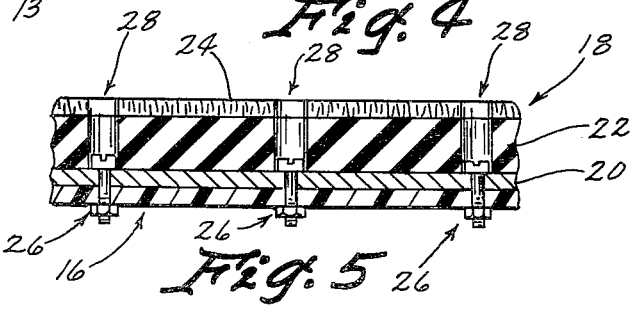
FIG. 5 is a partial sectional view taken on line 5—5 of FIG. 3.
Figure 6:
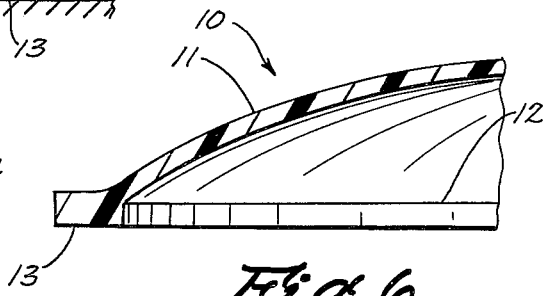
FIG. 6 is a partial sectional view taken at an enlarged scale on line 6—6 of FIG. 3.

26 can be inserted in aperatures 28 to detachably affix the panel 18 to the shell 11 within depression 16 as shown in FIG. 5.

The depth of panel 18 is substantially equal to the depth of depression 16 so that the top of the panel blends with the adjacent top surface of shell 11. While the depression area 16 defines the most important area for the material of panel 18, it is understood that a greater area of shell 11 could be superimposed with panel 18 without departing from the scope of this invention.

In operation, the panel 18 through the resilient layer 22 in combination with the turf layer 24 provides excellent footing for the pitcher as the pitching motion is made. The resilient and frictional characteristics thereof permit the conventional cleats on baseball shoes to effectively and firmly grip the panel.

The turf material 13 on the lower edge 12 of the shell 11 serves to adhere the mound to either an earthen or artificial surface so that the mound will not shift or slide while being used.

From the foregoing, it is seen that this invention will accomplish at least all of its objectives.

I claim:

1. A portable pitching mound, comprising, an arcuate shell member having forward and rearward ends, opposite side portions, an upper surface and an opposite generally concave underside, a pitching rubber centrally mounted on the upper surface of said shell member, a depression area formed in said shell member and extending at least from said pitching rubber forwardly and outwardly to the forward end of said shell member, and a panel, including a resilient and frictional cushion material, mounted in said depression to provide frictional footing to a pitcher pitching from said pitching rubber so that the force transmitted by a pitcher's foot to said shell is partially absorbed, said panel having a top surface and substantially filling said depression so that the top surface of said panel blends with the adjacent upper surface of said shell member to present a substantially continuous surface free of vertical wall portions.

2. The pitching mound of claim 1 wherein said shell has a peripheral supporting edge, and a strip of frictional material secured to said peripheral edge to cause said shell member to frictionally engage a supporting surface.

3. The pitching mound of claim 1 wherein said panel includes a layer of turf material overlying and being secured to said resilient and frictional cushion material.

4. The pitching mound of claim 3 wherein said panel further includes a lower supporting plate, said resilient and frictional cushion material overlying and being secured to said lower supporting plate.

5. The pitching mound of claim 1 further comprising disengageable fastening means for detachably securing said panel in said depression.

* * * * *